US006913019B2

(12) United States Patent
Johns et al.

(10) Patent No.: US 6,913,019 B2
(45) Date of Patent: Jul. 5, 2005

(54) PRESSURE ALLEVIATING PILLOW

(76) Inventors: Mary Elizabeth Johns, 216 Harrington Dr., Anadarko, OK (US) 73005; Tracy Nasca, P.O. Box 146, Chaska, MN (US) 55318

( * ) Notice: Subject to any disclaimer, the term of this patent is extended or adjusted under 35 U.S.C. 154(b) by 0 days.

(21) Appl. No.: 10/440,700

(22) Filed: May 19, 2003

(65) Prior Publication Data

US 2003/0217412 A1 Nov. 27, 2003

Related U.S. Application Data

(60) Provisional application No. 60/381,952, filed on May 21, 2002.

(51) Int. Cl.[7] ..... A61G 15/12; A47C 20/00

(52) U.S. Cl. ..... 128/845; 5/636

(58) Field of Search ..... D6/601; 5/636, 5/638, 643, 652, 655.9

(56) References Cited

U.S. PATENT DOCUMENTS

| | | | | | |
|---|---|---|---|---|---|
| 2,295,906 | A | | 9/1942 | Lacour | |
| D174,778 | S | * | 5/1955 | Smith | D6/601 |
| 3,667,074 | A | | 6/1972 | Emery | |
| 4,118,813 | A | * | 10/1978 | Armstrong | 5/638 |
| D250,985 | S | | 2/1979 | Armstrong | |
| 4,349,925 | A | | 9/1982 | Macomber | |
| 4,365,371 | A | * | 12/1982 | Boussaroque | 5/728 |
| 4,752,064 | A | * | 6/1988 | Voss | 5/638 |
| D308,787 | S | | 6/1990 | Youngblood | |
| D318,203 | S | * | 7/1991 | Zaghini | D6/601 |
| 5,088,141 | A | | 2/1992 | Meyer et al. | |
| 5,153,960 | A | * | 10/1992 | Ritter et al. | 5/640 |
| 5,216,770 | A | | 6/1993 | Holt | |
| D337,914 | S | * | 8/1993 | McDonald | D6/601 |
| 5,269,035 | A | * | 12/1993 | Hartunian | 5/638 |
| 5,457,832 | A | | 10/1995 | Tatum | |
| 5,613,501 | A | * | 3/1997 | Michelson | 5/637 |
| D388,648 | S | * | 1/1998 | Bates | D6/601 |
| 5,708,998 | A | | 1/1998 | Torbik | |
| 5,926,880 | A | | 7/1999 | Sramek | |
| D414,066 | S | | 9/1999 | Denney | |
| D414,974 | S | * | 10/1999 | Marrone et al. | D6/601 |
| 6,000,401 | A | | 12/1999 | Herrick | |
| D418,711 | S | * | 1/2000 | Mettler | D6/601 |
| 6,044,505 | A | | 4/2000 | Friedman | |
| 6,131,219 | A | | 10/2000 | Roberts | |
| 6,523,202 | B2 | * | 2/2003 | Loomos | 5/653 |

* cited by examiner

*Primary Examiner*—Michael Safavi
(74) *Attorney, Agent, or Firm*—James F. Harvey, III; Derrick W. Harvey

(57) ABSTRACT

The present invention provides a pillow for use by a patient during sleep, where the patient must wear a facially oriented medical device, such as a positive air pressure system. The invention provides a uniquely shaped pillow having recesses sized to allow the facially oriented medical device to be worn while the patient sleeps on his or her side, the device cantilevered over the recess and away from the pillow while the patient's head is supported by the patient's forehead, chin. A semi-rigid side panel and a resilient filler material provides sufficient support to prevent the facially oriented medical device from touching the horizontal surface upon which the pillow rests.

20 Claims, 4 Drawing Sheets

PRESSURE ALLEVIATING PILLOW

This application claims the benefit of U.S. Provisional Patent Application Ser. No. 60/381,952, filed May 21, 2002.

BACKGROUND OF THE INVENTION

The present invention relates to the field of medical devices. More specifically, the invention relates to a pillow that allows a positioning of a patient to minimize the interference with medical devices associated with the face.

Pillows are used during sleep both for comfort of a patient and to position a patient's head in a certain orientation. One purpose of pillows is to position the head of a patient so as to prevent obstruction of the patient's airway, particularly in treating mild sleep apnea and snoring. Sleep apnea refers to a collection of conditions and syndromes that are characterized by periods of apnea, or the temporary cessation of breathing. Sleep apnea syndromes may be classified into three main categories: central, obstructive, and mixed. Central sleep apnea refers to apnea syndromes with origins in the central nervous system. Obstructive sleep apnea (OSA) refers to apnea syndromes due primarily to the collapse of the upper airway during sleep. Mixed apnea refers to apnea with both central and obstructive characteristics.

In the case of OSA, a number of medical and surgical treatment options exist. Preferred nonpharmacologic treatments include weight reduction, tongue-retaining devices, and positive airway pressure modalities such as continuous positive airway pressure (CPAP) and bilevel positive airway pressure (BiPAP). Air pressure is prescribed in centimeters of water at a level sufficient to maintain an open patent airway in all positions and stages of sleep. CPAP involves the administration of air at a fixed positive pressure through the nose or mouth by an external device to maintain a clear upper airway. BiPAP is similar to CPAP, but it is capable of generating two alternating pressure levels, a higher inspiratory and lower expiratory. AutoPAP systems adjust or self-titrate through out the night based on body position and stage of sleep.

The symptoms of sleep apnea are most pronounced when a person afflicted with the condition sleeps in a supine position. Supine shall herein be defined as lying on the back or having the face upward. When a patient sleeps in a supine position, gravity causes the jaw and mandible to move downwardly. The downward movement of the jaw and mandible may block or obstruct the patient's airway. Occasionally the back of the tongue may also contribute to this obstruction. During bouts of extreme snoring (sometimes associated with sleep apnea), the uvula may also contribute to airway obstruction. During these periods of obstruction, the patient ceases to breathe normally, and carbon dioxide accumulates within the bloodstream until it causes an arousal from the sleeping patient to re-open the airway. The arousal may cause the person to move laterally, shake, or lurch, until the jaw, mandible, or tongue is repositioned and ceases to obstruct the airway or the relaxed muscles respond to reopen the collapsed airway.

A number of methods involving pillows have been proposed to alleviate this condition. U.S. Pat. No. 6,000,501, issued to Herrick, discloses a pillow that uses upper and lower tiers to support a patient's head at a selected angle or elevation from the horizontal. The pillow aims to prevent the patient's mandible, jaw, and tongue from the downward movement that contributes to sleep apnea and snoring while a the person sleeps on his or her back. Herrick's invention typifies the concept of preventing sleep apnea, through altering the position of the mandible.

Another approach may be found in U.S. Pat. No. 5,708,998, issued to Torbik, which discloses a cervical pillow with a central depression, neck rolls, and side cut-outs. The Torbik invention, while attempting to provide better air circulation for breathing, uses angled side edges that compress and expand laterally given the contents of Torbik's pillow. The neck roll assures that the patient's neck is placed along the bottom edge of the pillow.

U.S. Pat. No. 4,349,925, issued to Macomber, discloses a pillow with a head area, a chest area, and recesses for eye and nose clearance. Macomber's invention attempts to relieve pressure from a stomach sleeper's eyes, nose, throat, shoulders, and the blood vessels and glands of the neck. The pillow comprises a soft, yielding core, and is seamed to a tapered edge at its sides, notably the side supporting the face. The tapering of the pillow's sides gives it a collapsing effect onto the horizontal surface (or bed). Thus, while Macomber's invention may alleviate some pressure around the eyes, it ensures pillow or sheet contact with concerned areas of the face during sleep because of its collapsing effect. U.S. Pat. No. 3,667,074, issued to Emery, similarly discloses a pillow that collapses at its seamed sides.

U.S. Pat. No. 5,457,832, issued to Tatum, discloses a pillow that provides a central neck resting portion that claims to maximize the opening of a patient's oropharynx, thus alleviating a source of blockage. Tatum's pillow is configured to allow the patient's head to rest directly upon the mattress or on a thinner section of the pillow.

These examples illustrate the concept of preventing mild subclinical sleep apnea through positional means. The examples do so by addressing a patient's body from the neck up, utilizing various means to physiologically manipulate this region to prevent blockage. These examples do not address muscular airway collapse or obstructions caused by nonpositionally responsive physical anomalies, such as enlarged tonsils, adenoids, turbinates, etc.

Patients diagnosed with clinically significant OSA may be prescribed a positive air pressure delivery system, such as the CPAP, AutoPAP, or BiPAP systems mentioned herein, for use during sleep. The CPAP, AutoPAP, and BiPAP systems each comprise an airflow generator, hose, self-sealing nasal and/or oral interface, and provide a positive air stream to maintain an open air passageway for OSA patients. The effectiveness of the CPAP and BiPAP system concept as a treatment for sleep apnea is well documented. Medicare approved national coverage for CPAP treatment in 1986, soon after the inception of the treatment. The American Thoracic Society in 1994 published an official statement advocating the treatment, reporting that "CPAP is effective in the treatment of patients with clinically important obstructive sleep apnea/hypopnea syndrome."

One drawback to these otherwise effective positive air pressure treatments involves the issue of keeping the mask sealed upon a patient's face, and specifically, the patient's nose and mouth. As the patient sleeps, a normal pillow or even those formerly exhibited tend to dislodge the seal around the patient's nose/mouth because the face and nose are constantly in contact with either the pillow or the horizontal surface. When the seal around the patient's nose and/or mouth breaks, air pressure is lost through the resulting leak, which in turn alters the prescribed therapeutic pressure. Another drawback with existing pillows is that such contact with the collapsing pillow or horizontal surface adds pressure to and irritates the facial areas adjoining the interface, impairing sleep for the patient and encouraging the patient to abandon therapy.

Because CPAP and BiPAP systems are relatively new, technology has yet to resolve the important issue of improving the user's ability to actuate CPAP and BiPAP systems effectively and efficiently during sleep. U.S. Pat. No. D250,985, issued to Armstrong, discloses a pillow with interesting features; however, Armstrong's patent issued well before the inception of CPAP technology and the issues stemming from it. Furthermore, Armstrong's vertical ridge coupled with its sharp side cutouts make it inappropriate for solving this particular problem of interface interference. If such a technology did exist to solve this problem, however, many of those who suffer from sleep apnea but have abandoned CPAP or BiPAP treatments could again seek viable treatment.

Thus, it can be seen that there is a need for an apparatus that facilitates the use of CPAP, AutoPAP and BiPAP treatments for sleep apnea patients during sleep. The apparatus should alleviate pressure between the interface and the patient's face, so that the seal of the interface on the patient's face is not compromised. The apparatus should also relieve irritation to the patient's face caused by pressure to the interface and afford the patient a comfortable, quality sleep. It is desirable that the apparatus be easy and inexpensive to manufacture.

SUMMARY OF THE INVENTION

The present invention achieves its intended purposes, objects, and advantages through a new, useful, and unobvious combination of component elements, with the use of a minimum number of functioning parts, at a reasonable cost to manufacture, and by employing only readily available materials. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

In one aspect of the invention, a pressure alleviating pillow for use in combination with a positive air pressure system is given. The positive air pressure system comprises a positive air pressure device, a hose, and an interface with a patient's oral or nasal areas, wherein a gas with a prescribed positive air pressure provided by the device is delivered through the hose to the interface to treat sleep apnea and other related medical conditions. The pillow comprises a top panel with a concave shoulder recess, a first forehead projection and a first chin projection, the projections having a first concave facial recess therebetween; a bottom panel having substantially the same shape as the top panel and resting on the horizontal surface; a vertical side panel with a top edge connected to the perimeter of the top panel and an bottom edge connected to the perimeter of the bottom panel; and a resilient filler material contained with a space bounded by the top panel, the bottom panel, and the side panel. The pillow may be sized so that upper projection supports the patient's forehead and the lower projection supports the patient's chin, so that the interface projects outwardly from the concave facial recess without making contact with the top panel. The side panel in cooperation with the resilient filler material maintains the interface a distance from the horizontal surface without making substantial contact with the side panel.

In another aspect of the invention, a pressure alleviating pillow for use with facially positioned medical devices requiring clearance of the mouth and nasal regions is described, the invention comprising a pressure alleviating pillow having a top panel with a concave shoulder recess, a first forehead projection and a first chin projection, the projections having a first concave facial recess therebetween; a bottom panel having substantially the same shape as the top panel and resting on the horizontal surface; a vertical side panel with a top edge connected to the perimeter of the top panel and an bottom edge connected to the perimeter of the bottom panel; and a resilient filler material contained with a space bounded by the top panel, the bottom panel, and the side panel. The pillow may be sized so that the forehead projection supports the patient's forehead and the chin projection supports the patient's chin when the patient's shoulder abuts the pillow, so that the facially positioned medical device projects outwardly from the concave facial recess without making contact with the top panel. It may also maintain the facially positioned medical device a distance from the horizontal surface without making substantial contact with the side panel by a cooperative arrangement of a semi-rigid side panel and the resilient filler material. The side panel advantageously may have a height of from three to seven inches.

These and other features, aspects and advantages of the present invention will become better understood with reference to the following drawings, description and claims. For a better understanding of the invention, its operating advantages and the specific objects attained by its uses, reference should be made to the accompanying drawings and descriptive matter in which there are illustrated preferred embodiments of the invention. The foregoing has outlined some of the more pertinent aspects of the invention. These aspects should be construed to be merely illustrative of some of the more prominent features and applications of the present invention. Many other beneficial results can be attained by applying the disclosed invention in a different manner or by modifying the invention within the scope of the disclosure. Accordingly, other aspects and objects may be discerned from a fuller understanding of the invention and the detailed description of the preferred embodiments in addition to the scope of the invention illustrated by the accompanying drawings.

BRIEF DESCRIPTION OF THE DRAWINGS

FIG. 6 is a top view of a pressure alleviating pillow in use with a positive air pressure system featuring a full face interface, according to preferred embodiments of the current invention.

DETAILED DESCRIPTION OF THE INVENTION

Figure 1:
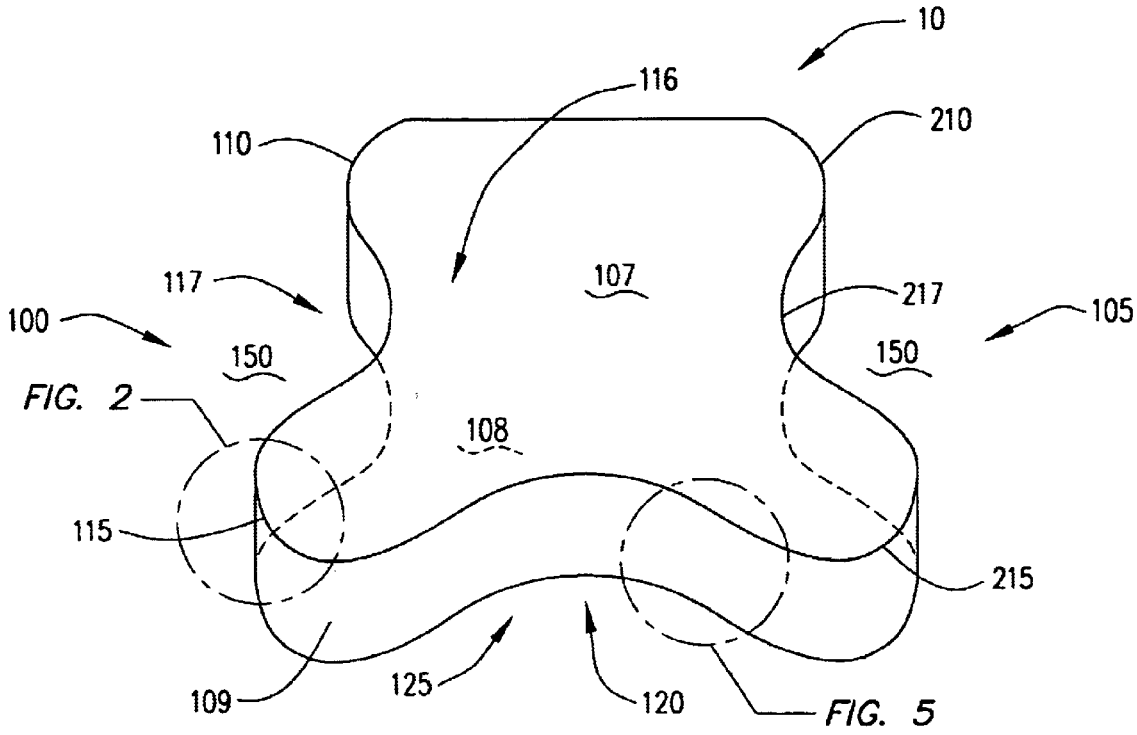
FIG. 1 is a top view perspective of a pressure alleviating pillow, according to preferred embodiments of the current invention.

The following detailed description shows the best currently contemplated modes of carrying out the invention. The description is not to be taken in a limiting sense, but is made for the purpose of illustrating the general principles of the invention and the best mode for practicing the invention, since the scope of the invention is best defined by the appended claims.

Physicians often prescribe the use of positive air pressure systems for patients diagnosed with sleep apnea. These positive air pressure systems may consist of a positive air pressure device, a hose, and a self-sealing nasal and/or oral interface. The positive air pressure device provides a gas under positive pressure to the hose for delivery thereby to the interface. The interface may be held to the patient's facial area by a strap around the back of the head, or similar means, to maintain a leakproof seal around the nasal and oral areas of the face. Thus, air under positive pressure is forced into the patient's airway by the device. The use of such positive air pressure systems generally requires that the patient adopt a stomach or side sleeping orientation, because a supine orientation allows the patient's mandible and uvula to descend into the throat by force of gravity and block the air passage, thus exacerbating the sleep apnea condition and requiring higher air pressure for relief. A positive air pressure system thus operates best when the patient sleeps upon his or her side or stomach so as to prevent the descension of the mandible and uvula into the throat, thereby providing an unobstructed passage of forced air from the positive air pressure system into a patient's airway. The positive air pressure provided by the system maintains an open patent airway, thus treating the main cause behind sleep apnea.

However, in spite of the effectiveness of treatment by positive air pressure systems, sleep apnea patients often discontinue this treatment for several reasons. First, because of pressure against the interface from the surface supporting the head, the pressurized seal between the self-sealing nasal or oral interface and patient's nose or mouth may break or leak while the patient sleeps. This disrupts the pressurized airflow, and the efficacy of the patient's treatment is significantly diminished. Leaking air may also create noise that arouses the patient and may also leak into the eye area to contribute to conjuctivitis. Second, patients use pillows to remove the pressure against the interface and promote comfortable sleep; however, a normal pillow also presses against the interface to cause patient discomfort resulting from such pressure. This discomfort prevents a restful sleep for the patient, resulting in the patient removing the interface and abandoning therapy.

The present invention effectively addresses such issues associated with positive air pressure systems such as AutoPAP, CPAP and BiPAP, by providing an inventive pillow having a number of functional advantages and structural differences over other pillows disclosed in the art. The present invention provides a stable, comfortable platform of uniform depth throughout the top and bottom plane that allows the positive air pressure system to function properly while the patient is in a side sleeping orientation. It does so by providing a side recess to isolate the nose and mouth from the pillow and thus allows unhindered operation of the positive air pressure system. The inventive pillow also features a bottom recess for placement of the downward shoulder to anchor the pillow and maintain alignment of the side recess with the patient's nasal or oral interface. The pillow further provides a rigid side panel and resilient filler material to ensure that the pillow supports the patient's head from a horizontal surface.

Figure 3:
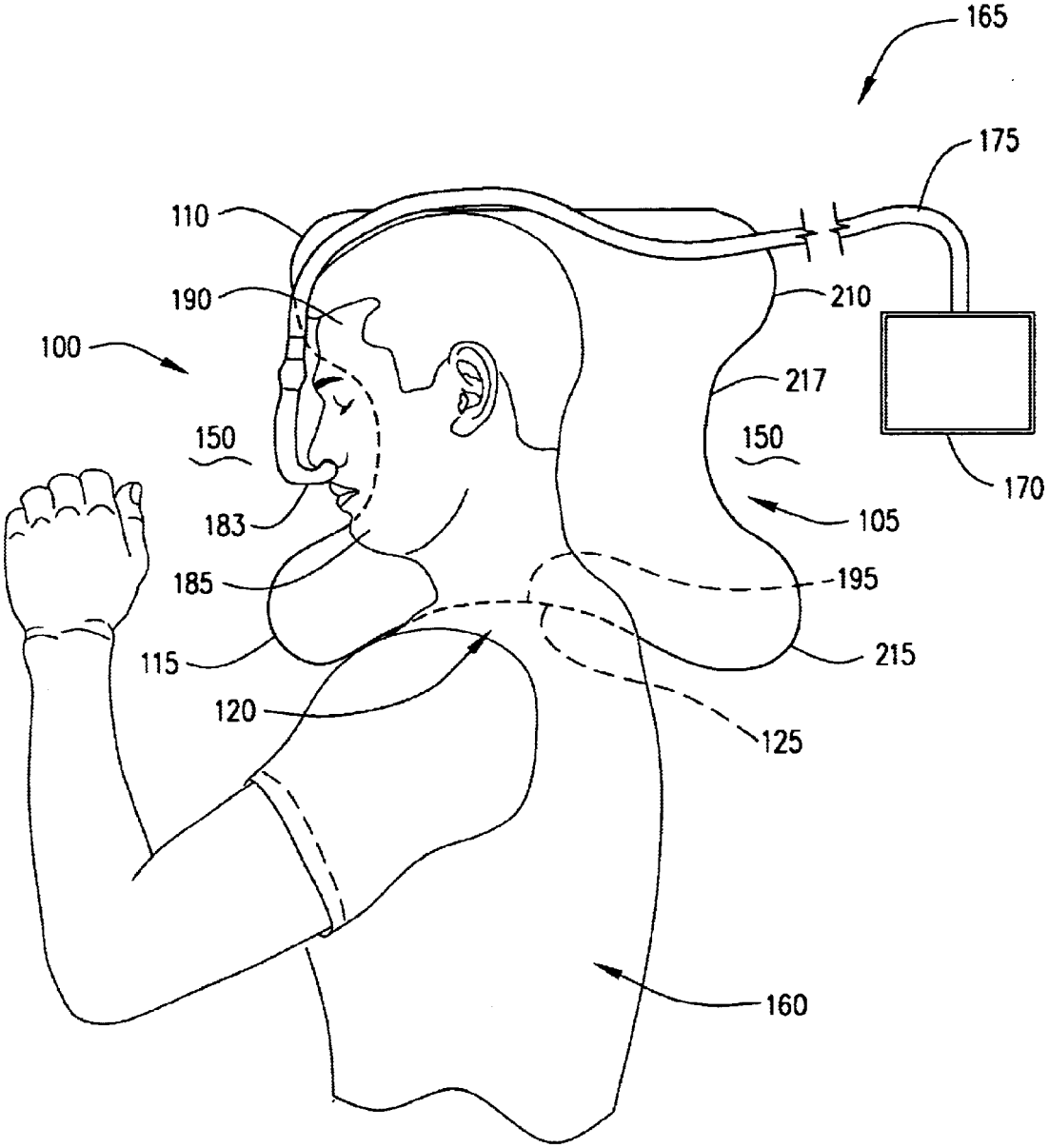
FIG. 3 is a top view of a pressure alleviating pillow in use with a positive air pressure system featuring a nasal interface, according to preferred embodiments of the current invention.

Referring now to FIG. 1 and FIG. 3, an embodiment of the invention is disclosed as pressure alleviating pillow 10. Pressure alleviating pillow 10, generally resting on a horizontal surface 150, may comprise an enclosed structure having a uniquely shaped top panel 107 and a similarly shaped bottom panel 108 held substantially in a generally uniform spaced relationship with one another by side panel 109 that is attached to the perimeters of the panels 107, 108. Pillow 10 may further comprise a first side 100, a second side 105, and a bottom side 120. First side 100 may further comprise an upper projection 110 and a lower projection 115. Upper projection 110 may provide support for the forehead 190 of the patient 160 and lower projection 115 may correspondingly provide support for the chin 185 of the patient 160. Projections 110, 115, may be integral to and protrude distally from the pillow 10, thus forming a first recess 117 therebetween.

The first recess 117 may have a concave shape similar to a parabolic curve. First recess 117 may also resemble other shapes and curves that isolate the patient's nose and mouth from the pillow 10, as illustrated in FIG. 3, without departing from the scope of the invention. The edge of first recess 117 generally defines the edge of the facial support area 116 and extends sufficiently interior into pillow 10 so that the patient 160 may make contact with the pillow 10 primarily at the projections 110, 115 and facial support area 116. Because first recess 117 curves into the pillow 10 in a concave aspect, it may advantageously prevent contact of the pillow with any facially positioned medical device that is associated with the mouth and nose regions of patient 160. Thus, the facially positioned medical device is cantilevered away from the pillow 10 without any significant supporting surface beneath, while the patient's head is supported at the patient's forehead 190 by the upper projection 110, at the patient's chin 185 by the lower projection 115, and at the side of the patient's face at facial support area 116.

The bottom side 120 of pillow 10 may comprise a bottom recess 125 having a generally concave aspect and designed to receive a shoulder 195 of the patient 160 while the patient is lying in a side sleeping orientation. As shown in FIG. 3, the patient 160 is shown lying on the patient's right side with the patient's right shoulder (hidden by the uppermost shoulder) abutting bottom recess 125. Bottom recess 125 is sized so that the patient may position the shoulder into and against bottom recess 125, thereby orienting the forehead 190 and chin 185 to generally rest at upper projection 110 and lower projection 115, respectively.

Pillow 10 may also have a second side 105 laterally opposing the first side 100, as shown in FIG. 1. Second side 105, similar to first side 100, may contain an upper projection 210 and a lower projection 215 generally aligned to support the patient's forehead 190 and chin 185, respectively, when the patient is lying on the side opposite that shown in FIG. 3. Second side 105 may further comprise a second recess 217 between the projections 210, 215 to isolate the patient's forehead 190 and chin 185 in a manner similar to that of the first side 100. Second side 105 may permit pillow 10 to be used by a patient facing in the direction of either side 100, 105. Thus, the patient may sleep on either side without turning the pillow; such turning action may be hampered by the presence of the protruding hose 175 of the facially positioned medical device and require arousal of the patient to accomplish the turning action.

Side panel 109 maintains the patient's head and also top panel 107 a sufficient distance from the horizontal surface 150 upon which pillow 10 rests, thereby keeping the facially positioned medical device from touching the horizontal surface 150. The horizontal surface 150 may typically be a bed or any other surface used for sleeping and/or medical positioning. Side panel 109 may have a semi-rigid quality so that it resists the outward bulge of filler material internal to the pillow that is laterally urged when the patient's head is resting upon the pillow 10 and thus holds the patient's head a distance from the horizontal surface 150.

Figure 2:
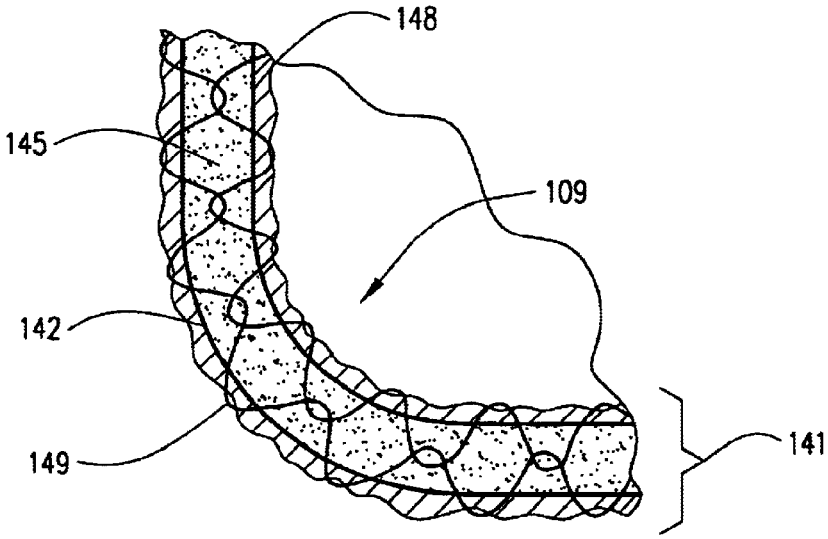
FIG. 2 is a top cut away drawing taken from FIG. 1, showing details of the side panel quilting of the pressure alleviating pillow, according to preferred embodiments of the current invention.
Figure 5:
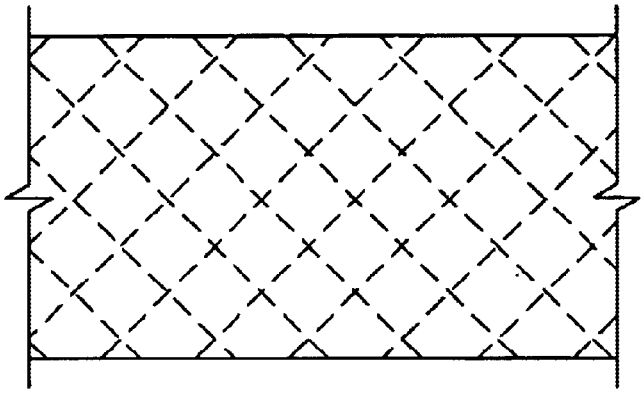
FIG. 5 is a close up view of the side panel taken from FIG. 1, showing details of the quilting providing side panel rigidity, according to preferred embodiments of the current invention.
Figure 5:
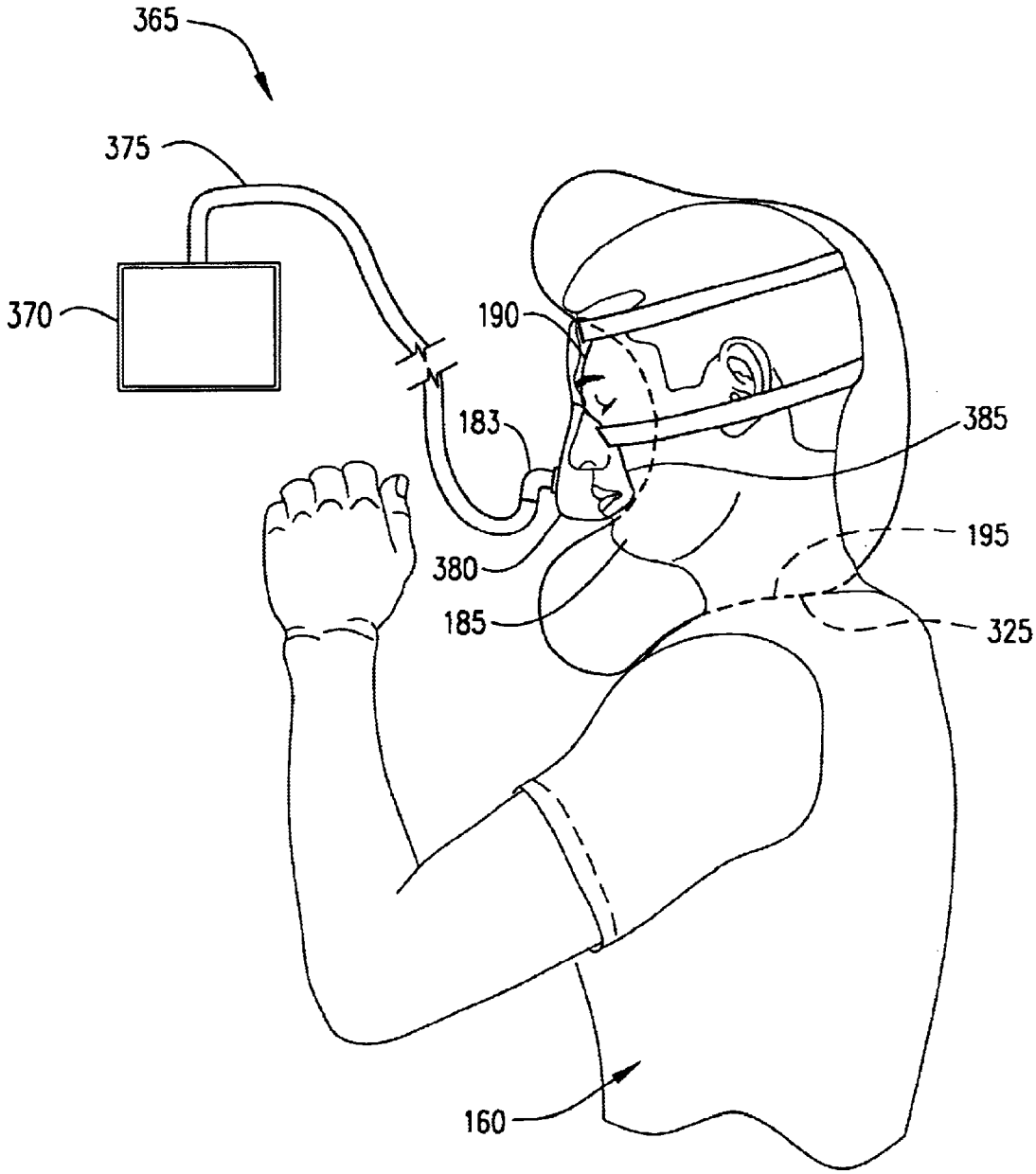

Although other methods may be used to impart a semi-rigid quality to side panel 109 without departing from the scope of the invention, the preferred method is to apply a quilting layer to the internal side of side panel 109. FIG. 2 shows a top cross sectional view of side panel 109 taken as indicated from FIG. 1. The side panel 109 as shown may comprising a layered quilting 141. Layered quilting 141 may have three layers, a outer woven fabric 142, a fill mat 145, and a back woven fabric 148, the three layers interconnected by a lockstitching 149. When such standard lockstitching is employed, the external of side panel 109 may resemble the arrangement shown in FIG. 5, where each stitch that protrudes from the outer woven fabric 142 is shown as a short dashed line. Other stitching methods and fabric constructions may be used to interconnect the layers without departing from the scope of this invention in order to achieve the purpose of providing a semi-rigid and supportive side panel, such as non-woven, fuseable or bonded fabrics, or the application of a stiffening agent to the side panel 109.

Side panel 109 may be composed of various materials and fabrics that are suitable for the particular use and environment in which the pillow is used. For example, if the resilient filler material is gas, water, gel, or some other fluid media, then side panel 109 may be constructed of a fluid-proof material, such as vinyl or plastic. Fluid-proofing may also be used in medical applications, both as a material for side panel 109 as well as for the exterior of the entire pillow 10, in order to prevent staining and enhance maintainability.

Side panel 109 maintains the semi-rigid side shape of the pillow 10 by promoting uniform distribution and depth of the resilient filler material. Pillow 10 would otherwise be compressed at the edges and elevated centrally if upper and lower surfaces were joined without the side panel 109 and did not utilizes resilient fill through the interior of pillow 10. The resilient filler material may be comprised of types of material providing rigid support and resilience. The resilient filler material should not collapse nor urge side panel 109 to flare distally away from the pillow 10. By means of example and not limitation, the material polyolefin and other polyfills possess the requisite attributes of resiliency, rigidity, and noncollapsability and are preferred. Other possible fills may comprise down, feathers, liquids, gases, standard or slow recovery foams, or any other material providing comfort and resilient support of the patient's head, but polyolefins are preferable. Even more preferable is a resilient fill material comprising a seventy percent mix of processed synthetic polyolefin and thirty percent polyester. The uniform distribution and depth of the resilient filler material prevents the middle of the side panel 109 from distally flaring out from the pillow 10. Such flaring may otherwise cause portions of pillow 10 to press against a patient's mouth and nose areas. It has been found that a side panel having a height of approximately three to seven inches maintains a suitable spacing between the patient's facial area and the horizontal surface 150.

Pillow 10 may additionally comprise a pillowcase or cover, the cover having the same shape and size as pillow 10. The cover may be constructed from a variety of fabrics, fit for functions such as comfort, medical (disposable), or fluid-proofing.

Figure 4:
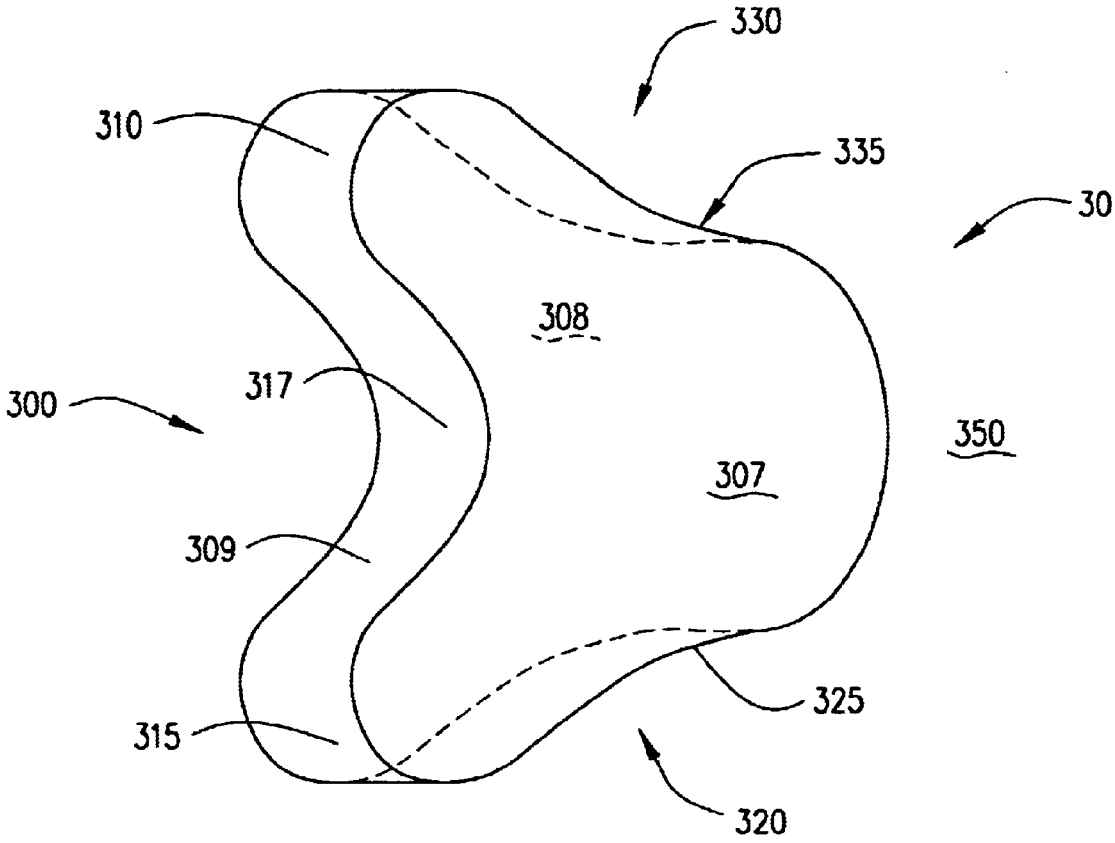
FIG. 4 is a top view perspective of a pressure alleviating pillow, according to preferred embodiments of the current invention.

Now referring to FIG. 4 and FIG. 6, another embodiment of the invention is disclosed as a pressure alleviating pillow 30. Pressure alleviating pillow 30 may comprise a top panel 307 and a bottom panel 308 held substantially in a generally uniform spaced relationship with one another by side panel 309 that is attached to the perimeters of the panels 307, 308. Pillow 30 may further comprise a first side 300 and a bottom side 320. First side 300 may comprise an upper projection 310 and lower projection 315. Upper projection 310 supports the forehead 190 of the patient. Lower projection 315 supports the chin 185 of the patient. Upper and lower projections 310, 315, may be integral to and protrude distally from the pillow 30, forming a first recess 317 between the projections 310, 315, having the same aspect as first recess 117 described in FIG. 1.

Pillow 30 may further comprise a top side 330 with a top recess 335 and a bottom side 320 with p bottom recess 325, where the bottom recess 325 is designed to receive a shoulder 195 of the patient side sleeping. The recesses 325, 335 allow the pillow 30 with a first side 300 to be converted to a dual side use pillow. By tuming the pillow 30 upside down or flipping it over, either recess 325, 335 may be oriented towards the shoulder 195. Thus, a patient using pillow 30 may operate the pillow 30 In a right or left handed orientation, depending upon the location a facially oriented medical device or at the discretion of the patient. Pillow 30 may further have a side panel 309 with the same construction as described previously.

By way of example and not of limitation, the pressure alleviating pillow 30 may be advantageously used in combination with a positive air pressure system 365 as the facially oriented medical device. The positive air pressure system 365 may comprise a positive air pressure device 370 for providing a regulated flow of positive pressure gas, such as air or oxygen, to the patient's mouth and nasal areas. The field of sleep therapy is replete with examples of these types of devices that provide continuous or multiple levels of predetermined air pressure, splinting the airway open to permit normal breathing while the patient Is asleep. By way of example and not limitation, positive air pressure devices may be CPAP devices, AutoPAP devices, BiPAP devices, or other types of machines known to generate or provide air pressure. The positive air pressure system 365 may further comprise a hose 375 and an interface 380. Hose 375 conducts the pressurized air from the positive air pressure device 370 to the interface 380 and may be constructed out of materials well known to the art. Interface 380 is shown in FIG. 6 as covering both the oral and nasal areas of the face. By way of example and not limitation, the ResMed Ultra Mirage™ mask is a commonly prescribed oral and nasal, orfull face interface. The perimeter of interface 380 forms an interface seal 385 with the patient's face. The interface seal 385 may be disrupted if pressure against horizontal surface 350 and the pillow 10 is exerted. The side panel 309 accomplishes the task of isolating the Interface 380 from these interferences. Note that interface 380 may be any oral, nasal or full faced interface known in the arts to deliver positive air pressure to a patient's mouth or mouth and nose. Furthermore, the term "interface" as used herein may also be construed as meaning any facial medical device including but not limited to orthodontic appliances, headgear, emphysema treatment devices, or cannula that requires clearance from pillow or horizontal surface interference.

A nasal interface is shown in FIG. 3. Nasal interfaces are known throughout the medical art and may comprise nasal pillows, nasal puffs, dialators, and other types of medical devices interacting with a patient's nose. However, the present invention foresees use of any interface known in the medical arts. Nasal interfaces used in positive air pressure systems 165 may typically feature an exhalation port 183 connected by a hose 175 to a positive air pressure device 170, where the exhalation port 183, hose 175, and positive air pressure device 170 comprises a positive air pressure system 165. Exhalation port 183 requires clearance for the positive air pressure system 165 to operate properly and allow the patient to property evacuate exhaled gas to prevent rebreathing of carbon dioxide. Thus, during operation while the patient sleeps, the exhalation port 183 must not be blocked by either the pillow 10 or horizontal surface 150.

As has been demonstrated, the present invention provides an advantageous pillow for use with a positive air pressure system and other facially oriented medical devices. While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention.

We claim:

1. In combination with a positive air pressure system having a positive air pressure device for delivery of a pressurized gas through a hose to an interface, the interface making a seal with a patient's facial area to maintain the positive air pressure, the patient lying on the patient's side on a horizontal surface, a pressure alleviating pillow comprising a top panel with a concave shoulder recess, a first forehead projection and a first chin projection, the projections having a first concave facial recess therebetween;

a bottom panel having substantially the same shape as the top panel and resting on the horizontal surface;

a vertical side panel with a top edge connected to the perimeter of the top panel and an bottom edge connected to the perimeter of the bottom panel, the side panel comprising a semi-rigid material;

a resilient filler material contained with a space bounded by the top panel, the bottom panel, and the side panel;

wherein the forehead projection supports the patient's forehead and the chin projection supports the patient's chin, so that the interface projects outwardly from the concave facial recess without making contact with the top panel; and wherein the side panel in cooperation with the resilient filler material maintains the interface a distance from the horizontal surface without making substantial contact with the side panel.

2. The pillow described in claim 1, wherein the panels are comprised of the same material.

3. The pillow in claim 1, wherein the resilient filler material is comprised of polyolefin.

4. The pillow in claim 1, wherein the side panel comprises an exterior layer of quilting material.

5. The pillow described in claim 1, wherein the side panel is quilted.

6. The pillow described in claim 1, wherein the resilient filler material is comprised of a seventy percent processed synthetic polyolefin and thirty percent polyester mix.

7. The pillow described in claim 1, further comprising the top panel with a second forehead projection opposing the first forehead projection, a second chin projection opposing the first chin projection, and with a second concave facial recess between the second forehead projection and the second chin projection, wherein the patient can lie on either side and receive support for the patients head without moving the pillow.

8. The pillow in claim 1, the pillow further comprising a removable cover, the removable cover having the same shape and size as the pillow.

9. The pillow in claim 1, wherein the resilient filler material is comprised of polyester.

10. The pillow in claim 1, wherein the resilient filler material is comprised of a mixture of polyolefin and polyester.

11. A pressure alleviating pillow for use with a facially positioned medical device associated with the mouth and nasal regions, the pillow comprising a top panel with a concave shoulder recess, a first forehead projection and a first chin projection, the projections having a first concave facial recess therebetween;

a bottom panel having substantially the same shape as the top panel and resting on a horizontal surface;

a vertical side panel with a top edge connected to the perimeter of the top panel and a bottom edge connected to the perimeter of the bottom panel;

a resilient filler material contained within a space bounded by the top panel, the bottom panel, and the side panel, the resilient filler material comprised of a mixture of synthetic polyolefin and polyester;

wherein the forehead projection supports the patient's forehead and the chin projection supports the patient's chin, so that the facially positioned medical device projects outwardly from the concave facial recess without making substantial contact with the top panel; and wherein the side panel in cooperation with the resilient filler material maintains the facially positioned medical device a distance from the horizontal surface without making substantial contact with the side panel.

12. The pillow in claim 11, wherein the distance is in the range of three to seven inches.

13. The pillow in claim 11, the pillow further comprising the top panel with a second forehead projection opposing the first forehead projection, a second chin projection opposing the first chin projection, and with a second concave facial recess between the second forehead projection and the second chin projection, wherein the patient can lie on either side and receive support for the patient's head without moving or turning the pillow.

14. The pillow in claim 11, the side panel comprising a semi-rigid material.

15. The pillow in claim 11, wherein the side panel comprises a quilting material.

16. The pillow in claim 11, wherein the resilient filler material comprises a seventy percent processed synthetic polyolefin and thirty percent polyester mix.

17. A pillow comprising a top panel with a concave shoulder recess, a first forehead projection and a first chin projection, the projections having a first concave facial recess therebetween;

a bottom panel having substantially the same shape as the top panel and resting on the horizontal surface;

a resilient filler material contained with a space bounded by the top panel, the bottom panel, and a semi-rigid vertical side panel, the side panel with a top edge connected to the perimeter of the top panel and an bottom, edge connected to the perimeter of the bottom panel, the side panel having a quilting along its surface to resist the outward pressure of the resilient material against the side panel when a patient rests his head on the top surface, the resilient filler material comprised of a mixture of synthetic polyolefin and polyester;

wherein the forehead projection supports the patient's forehead and the chin projection supports the patient's chin, so that the patient's mouth and nasal regions projects outwardly from the concave facial recess without making contact with the top panel, thereby allowing an appliance to be associated with the patient's mouth and nasal regions without being subjected to pressure that might dislodge the appliance from the patient's mouth and nasal regions, and wherein the side panel in cooperation with the resilient filler material maintains the patient's mouth and nasal regions a distance from the horizontal surface without making substantial contact with the side panel.

18. The pillow in claim 17, the top panel further comprising a second forehead projection opposing the first forehead projection, a second chin projection opposing the first chin projection, and with a second concave facial recess between the second forehead projection and the second chin projection, wherein the patient can lie on either side and receive support for the patient's head without moving the pillow.

19. The pillow in claim 17, wherein the resilient filler material comprises a seventy percent processed synthetic polyolefin and thirty percent polyester mix.

20. The pillow in claim 17, the pillow further comprising a removable cover having the same shape and size as the pillow.

* * * * *